US010058907B2

(12) United States Patent
Klinkhammer et al.

(10) Patent No.: US 10,058,907 B2
(45) Date of Patent: Aug. 28, 2018

(54) DEVICES AND METHODS FOR PRESSURE FORMING CONNECTING WEBS BETWEEN WORKPIECE PARTS OF A PLATE-LIKE WORKPIECE

(71) Applicant: TRUMPF Werkzeugmaschinen GmbH + Co. KG, Ditzingen (DE)

(72) Inventors: Marc Klinkhammer, Ditzingen (DE); Markus Wilhelm, Gerlingen (DE); Takeshi Abiko, Ditzingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 158 days.

(21) Appl. No.: 15/142,666

(22) Filed: Apr. 29, 2016

(65) Prior Publication Data

US 2016/0318088 A1 Nov. 3, 2016

(30) Foreign Application Priority Data

Apr. 29, 2015 (EP) ..... 15165673

(51) Int. Cl.
*B21D 28/10* (2006.01)
*B21D 28/16* (2006.01)
*B21D 28/34* (2006.01)

(52) U.S. Cl.
CPC ..... *B21D 28/10* (2013.01); *B21D 28/16* (2013.01); *B21D 28/34* (2013.01)

(58) Field of Classification Search
CPC ..... B21D 28/10; B21D 28/16; B21D 28/34; B21D 28/06; B21D 22/206
USPC ..... 72/404
See application file for complete search history.

(56) References Cited

U.S. PATENT DOCUMENTS

| | | | |
|---|---|---|---|
| 4,362,078 | A | 12/1982 | Ohnishi et al. |
| 5,655,401 | A | 8/1997 | Bauer et al. |

FOREIGN PATENT DOCUMENTS

| | | |
|---|---|---|
| CN | 1964802 | 5/2007 |
| CN | 101107086 | 1/2008 |
| CN | 204159719 | 2/2015 |
| DE | 102012011767 A1 | 11/2013 |
| FR | 2751570 | 1/1998 |

*Primary Examiner* — Debra Sullivan
(74) *Attorney, Agent, or Firm* — Fish & Richardson P.C.

(57) ABSTRACT

A forming tool for pressure forming a connecting web between incompletely separated workpiece parts of a plate-like workpiece from a cutting operation, in particular a metal sheet, comprises two tool parts, of which each is provided with a forming unit. The tool parts are able to move towards each other along a stroke axis with a processing stroke to a stroke end position. Each of the forming units has a forming surface on a web side facing away from the respective workpiece part, wherein the said forming surface, starting from a front face of the forming unit extends along the stroke axis away from a workpiece side facing the respective workpiece part.

22 Claims, 6 Drawing Sheets

DEVICES AND METHODS FOR PRESSURE FORMING CONNECTING WEBS BETWEEN WORKPIECE PARTS OF A PLATE-LIKE WORKPIECE

CROSS-REFERENCE TO RELATED APPLICATION

This application claims priority under 35 U.S.C. § 119(a) to European Application No. 15 165 673.3, filed on Apr. 29, 2015, the entire contents of which are hereby incorporated by reference.

TECHNICAL FIELD

The invention relates to a forming tool and a machine tool provided with such a forming tool for pressure forming a connecting web, attached by its ends to workpiece parts and that connects together the workpiece parts that occur as processing products from an operation cutting plate-like workpieces, in particular metal sheets, each of which having a cut face transversely to which the connecting web extends

BACKGROUND

U.S. Pat. No. 5,655,401 discloses a forming tool that serves to reduce the cross section of connecting webs by means of which sheet metal parts produced by punching a metal sheet are connected to a skeleton surrounding the sheet metal parts. The connecting webs, also called "micro-joints", create a temporary connection between the sheet metal parts and the skeleton and ensure that, during and after the punching operation on the metal sheet, the produced sheet metal parts and the skeleton can be handled as a unit. To avoid that the connecting webs break under the effect of the stresses occurring while handling of the sheet metal parts and of the skeleton together, the connecting webs have to be dimensioned adequately. At the same time, it must be possible, after the joint handling of the sheet metal parts and of the skeleton, to release the sheet metal parts from the skeleton with minimal effort. To this end, the cross section of the connecting webs between the sheet metal parts and the skeleton is reduced by means of known forming tools.

The known forming tools include a forming punch with a beveled punch tip and a forming die with a planar support surface and a die recess sunk into the planar support surface. The forming punch is assigned to the one side of a connecting web to be processed and the forming die to the other side. With a processing stroke performed along a stroke axis, the forming punch is moved towards the forming die. In doing so, the forming punch acts upon the connecting web arranged between the forming punch and the forming die with the beveled punch tip. Due to the impact by the punch tip, the connecting web is squeezed and the thickness of the connecting web between the forming punch and the forming die thereby reduced, and, furthermore, the connecting web is bent over an edge that is formed on the forming die by the support surface and a surface that laterally delimits the die recess and extends parallel to the stroke axis.

As a result, a fracture zone is created on the connecting web where the cross section is reduced relative to the remainder of the connecting web. If all connecting webs between the sheet metal parts of the processed metal sheet and the skeleton surrounding the sheet metal parts are pressure formed in the described manner, just shaking the unit comprising the sheet metal parts and the skeleton is sufficient to break the connecting webs at the fracture zones, thereby detaching the sheet metal parts from the skeleton. In doing so, a burr that projects beyond the surface of the sheet metal parts is left and has to be removed mechanically.

SUMMARY

The invention relates to methods of pressure forming a connecting web of the type described herein by means of forming tools and/or machine tools. The invention further relates to methods for processing plate-like workpieces, in particular for processing metal sheets, in the course of which two workpiece parts are separated from each other. In these methods the two workpiece parts are first incompletely separated from each other with a cut face produced on each of the two workpiece parts and with at least one connecting web left, which connecting web is attached by its ends to the workpiece parts, thus connecting the workpiece parts together and which connecting web extends transversely to the cut faces. Next, after the incomplete separation of the workpiece parts, the connecting web is pressure formed; and then the two workpiece parts are completely separated from each other by removing the connection produced by the formed connecting web.

An objective of the present invention is to provide devices and methods that enable workpiece parts, incompletely separated from each other and connected together by connecting webs, occurring as processing products from cutting plate-like workpieces, to be completely separated from each other such that no post processing or hardly any post processing of the workpiece parts is required.

In embodiments of the invention, a forming tool is used which, due to the geometry of the forming units provided on the tool parts of the forming tool, creates, during the pressure forming of a connecting web left between two workpiece parts, a fracture zone on the end(s) of the connecting web, which fracture zone(s) is (are) configured such that, after breaking the connecting web, no or only minimal traces of the connecting web remain on the workpiece part(s). The forming units of the tool parts plunge into a connecting web as it is being pressure formed and, in doing so, displace material of the connecting web. Due to the geometry of the forming units of the forming tool according to the invention, the material of the connecting web plasticized by the forming tool is displaced away from the workpiece part(s) that are arranged adjacent to the connecting web. As a result, the material of the connecting web plasticized during the course of the forming process is able to leave behind no or only minimal traces on the workpiece part(s) concerned. Any burrs formed on the connecting web are removed together with the connecting web and consequently do not impair the quality of the cut face on the workpiece part(s). Depending on the application, for example, on the dimensioning of the width of the connecting web on the one hand and of the width of the forming units on the other, the tool parts of the forming tool according to the invention perform a single processing stroke or several sequential processing strokes to form a connecting web.

After a connecting web is pressure formed, the formed end of the connecting web has a relatively small cross section that is dimensioned such that the connection between the connecting web and the adjacent workpiece part can be removed with minimal effort, such as by moving the processed workpiece back and forth, with no burrs and practically no residue being left behind. Nevertheless, the connecting web can be dimensioned before pressure forming such that it provides a strong connection between the workpiece parts concerned.

It is possible that not only finished parts as workpiece parts can be connected to each other by connecting webs, but also one or several finished parts can be connected to a waste part, such as a skeleton. The connecting webs may be attached, for example, to straight or curved edges as well as to corners of the workpiece parts connected together. In the interests of providing the longest possible service life for the forming tool, the connecting webs should be aligned in relation to the forming units of the forming tool such that the connecting webs face the forming units along the stroke axis with surfaces and not with edges. Therefore, torsion of the connecting webs about their longitudinal axis must be avoided when the workpiece parts are incompletely separated.

Likewise, in the interests of optimizing the service life of the forming tool according to the invention, workpiece fragments that arise, for example, as swarf when pressure forming a connecting web can be removed from the processing site. For this purpose, in certain embodiments of the invention at least one of the tool parts of the forming tool according to the invention is provided with an appropriate extraction device. By removing workpiece fragments from the processing site, the workpiece fragments are also prevented from leaving traces on the workpiece parts to be separated from each other and, thus, from reducing the quality of the workpiece processing result.

On the machine tool according to the invention, the tool parts of the forming tool according to the invention are arranged in tool holders that are provided on opposite sides of the connecting web to be formed, or, respectively, of the workpiece parts connected together by the connecting web to be formed, and that can be moved under numerical control relative to each other along the stroke axis of the tool parts. It is also possible that the tool holders can be adjusted rotationally about the stroke axis together with the tool parts attached to them. The workpiece from the previous separating process usually rests on a conventional workpiece support of the machine tool. By executing, parallel to the plate plane of the processed workpiece, a movement of the workpiece parts and the connecting webs on the one hand and the tool holders of the machine tool on the other, the connecting webs are positioned for processing relative to the tool parts of the forming tool held in the tool holders.

During the forming process, pressure is applied by the forming units of the tool parts of the forming tool according to the invention on both sides of a connecting web to be formed. The line along which the forming units plunge at one end of the connecting web can extend in an extension of a cut face that had been created on the adjacent workpiece part when the connecting web was produced, alternatively it can be set back relative to this cut face into the interior of the workpiece part. In the last case, even if small residues of the connecting web remain on the workpiece part during separation of the connecting web from the workpiece part, it is guaranteed that no residues of the connecting web protrude from the cut face produced on the workpiece part when the connecting web is produced. If applicable, the forming units can overlap a workpiece part on the order of tenths of a millimeter.

The forming process according to the invention is a part of the cutting process according to the invention and also a part of the processing method according to the invention, in the course of which the cutting method according to the invention and, additionally, further workpiece processing is performed. As part of the processing method according to the invention, the forming tool according to the invention can serve to form the connecting web(s) in a manner that is coordinated with the workpiece processing provided in addition to the separation process. In particular, it is possible when forming the connecting web(s), to produce on a workpiece part geometries like those produced during the additional workpiece processing on the remaining cut face of the workpiece part concerned.

In some embodiments at least one of the tool parts has a support surface extending substantially perpendicular to the stroke axis, from that support surface the forming unit of this latter tool part projects towards the other tool part. During the forming process, the support surface forms an abutment for the connecting web to be formed, thereby preventing the undesired deformation of the processed connecting web.

Different geometries can be considered for the forming units of the tool parts of the forming tool according to the invention. In some embodiments, at least one of the forming units has a triangular cross section or a trapezoidal cross section in a section plane extending parallel to the stroke axis.

In some embodiments, a type of construction of the forming tool has a triangular cross section and the forming unit of the other tool part has a trapezoidal cross section. The front face of a forming unit with a triangular cross section is, in principle, linear. To increase the service life, such a forming unit in a certain embodiment of the invention can be provided with a slight flattening or rounding on the apex of the triangle forming the front face of the forming unit. Unlike a forming unit with a triangular cross section, a forming unit with a trapezoidal cross section has a planar front face. Cross sections other than trapezoidal that form a planar front face on the forming unit are also conceivable according to the invention.

Forming units with a triangular or with a trapezoidal cross section are provided in a further development of the invention in that the forming unit of a tool part is formed by a free end of the tool part provided with an internal cavity, such as an internal cone. During the pressure forming of a connecting web, material of the connecting web can flow into the interior of the cavity formed, for example, by the internal cone. As a result, the resistance is reduced that is offered by the connecting web against the processing by the forming tool according to the invention. In a further development of the invention, a radius or a chamfer can be provided at the transition between the front face of the forming unit concerned and the internal cone. The radius and the chamfer, if applicable, ensure that, when the workpiece parts are finally separated, the formed connecting web does not break at this place but, instead, breaks right where the connecting web meets the adjacent workpiece part.

In the pressure forming of the connecting web and the associated plunging of the forming units of the forming tool on at least one end of the connecting web, a cut face is produced by the forming units on the workpiece side. By configuring the forming units appropriately, the configuration of the cut face produced by the forming units can be influenced. If a forming unit has a sharp edge, the forming unit produces a smooth and thus high quality cut face.

In some embodiments, provision is made that at least one of the forming units extends on the workpiece side along the stroke axis parallel to the cut face or at an angle relative to the cut face on that workpiece part which the workpiece side of the forming unit is facing as the connecting web is being pressure formed. If the workpiece side of a forming unit is parallel to the cut face on the workpiece part concerned, the cut face produced by means of the forming unit on that workpiece part also extends parallel to the cut face of the workpiece part produced before the pressure forming of the connecting web. If the workpiece side of the forming unit extends at an angle relative to the cut face already produced before the forming of the connecting web on the workpiece part, the same applies to the cut face produced by means of the forming unit on the workpiece part.

A cut face extending parallel to the cut face on the workpiece part concerned is produced by means of the forming unit according to the invention in particular, if the cut face produced by means of the forming unit extends as an extension of the already present cut face on the workpiece part. Production of a cut face inclined at an angle to the already present cut face of the workpiece part by means of the forming unit is provided according to the invention in cases, for example, in which, before or after the connecting web is formed, the cut face already present on the workpiece part is formed by additional processing on the edge of the workpiece part to create a chamfer. By an appropriate choice of the angle between the workpiece side of the forming unit and the already present cut face of the workpiece part, the chamfered face produced by means of the forming unit on the workpiece aligns with the chamfered face produced during the additional edge processing of the workpiece part.

In some embodiments, the forming tool according to the invention is configured such that the forming unit of one of the tool parts produces on the workpiece part concerned a cut face that extends parallel to the already present cut face of the workpiece part, while the forming unit of the other tool part creates a cut face that extends at an angle relative to the already present cut face of the workpiece part.

In certain embodiments, the forming units on the tool parts of the forming tool according to the invention are offset transversely relative to the stroke axis. In so doing, a gap is produced between the two forming units that facilitates the oblique breaking of the connecting web after the forming operation. An angled fracture face on a workpiece part may be desirable, for instance in the case mentioned already, in which an angled face is also produced by edge processing of the workpiece parts also, to which angled face the angled fracture face on the workpiece part can then be matched.

If a connecting web creates a connection between two workpiece parts provided as finished parts, the connecting web must be separated with as little residue as possible from both workpiece parts.

In some embodiments, the forming tool allows a connecting web to be formed simultaneously at several places that are spaced apart from each other along the connecting web. Each of the forming places on the connecting web in this case is processed by two unit sections wherein the one unit section is part of the forming unit on the one workpiece part and the other unit section is part of the forming unit on the other workpiece part of the forming tool according to the invention.

For forming unit sections assigned to different processing places on a connecting web, in the case of the invention, various options are used for the design of the forming units on the tool parts of the forming tool according to the invention.

In some embodiments, the forming units on both tool parts of the forming tool according to the invention extend in a circumferential direction and, in particular in an arc-shaped manner, for example along a circular arc about the stroke axis. The extension of the forming units in a circumferential direction can be dimensioned such that the forming units are positioned simultaneously at several places of the connecting web as a connecting web is being formed. An arc-shaped, in particular a circular arc-shaped extension of the forming units offers the possibility that the fracture zone, at which the connecting web is supposed to break after forming, is arranged on the workpiece part adjacent to the connecting web in an area that is recessed, relative to the cut face already produced on this workpiece part before the forming of the connecting web, into the interior of the workpiece part. A circular extension of the forming units is further advantageous insofar as, by a simple rotational adjustment of the tool parts about a positioning axis concentric with the forming units, different unit sections of the forming units can be assigned to one and the same processing place and/or one and the same unit section can be assigned to different processing places. The successive use of different unit sections of a forming unit is recommended in particular in view of the balancing out of the tool wear achievable thereby.

In some embodiments of the forming tool, at least one of the forming units extends endlessly in the circumferential direction. Alternatively, in the case of the invention, also forming units segmented in the circumferential direction are conceivable.

In some embodiments, the control of the processing stroke for the pressure forming of a connecting web is force-dependent.

In certain embodiments of the forming tool, a force-dependent control of the processing stroke of the tool parts of the forming tool. A mutual support of the tool parts, effective along the stroke axis and bypassing the pressure formed connecting web is provided in a certain embodiment of the forming tool according to the invention, in that at least one of the tool parts is shaped like a portal and spans the connecting web to be formed during the processing thereof. The portal columns of the tool part concerned can rest on the other tool part laterally beside the connecting web when the two tool parts are in the stroke end position. The forming unit can be arranged between the portal columns on the tool part(s) provided with at least one projection.

In other embodiments, in processing a plate-like workpiece made of an elastically deformable material, the at least one connecting web is produced as a flexure hinge and is resilient in the transverse direction of the cut faces of the workpiece parts connected together by the connecting web. If such a connecting web is formed by means of the forming tool according to the invention and, in doing so, pressure is applied on two places spaced apart from each other along the connecting web, in particular on both opposing ends of the connecting web, the area of the connecting web, arranged between the two contact points of the forming tool, can be compressed using the elasticity of the connecting web. As a result, only a comparatively small amount of force is needed to form the connecting web.

The invention is explained in more detail below with the aid of exemplary and diagrammatic illustrations.

DETAILED DESCRIPTION

Figure 1:
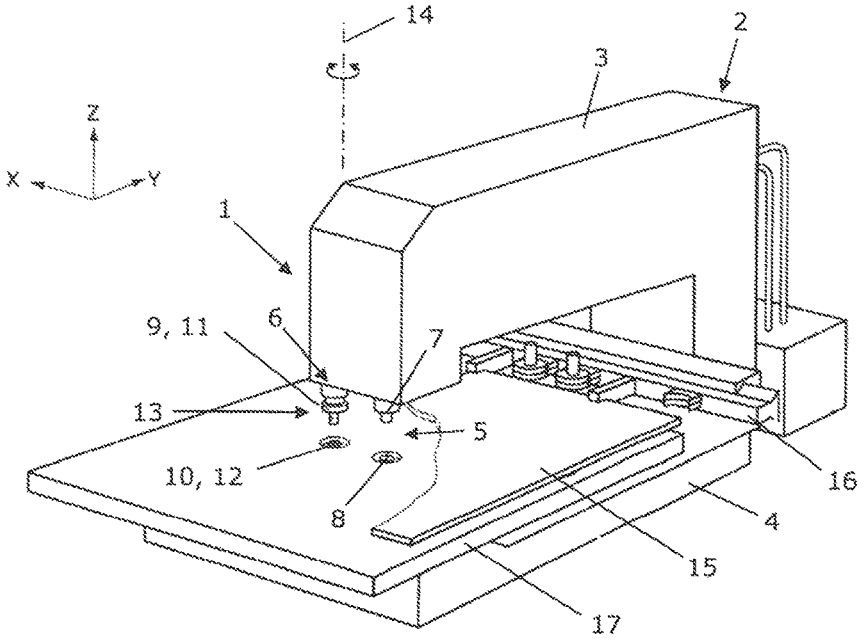
FIG. 1 illustrates a machine tool for sheet metal processing having a cutting station and a forming station.

According to FIG. 1, a machine tool 1 is configured as a combined punching/laser machine. A machine frame 2 of the machine tool 1 is C-shaped and has an upper frame leg 3 and a lower frame leg 4. A laser-cutting station 5 and a forming station 6 are provided at the free ends of the upper frame leg 3 and of the lower frame leg 4.

The laser-cutting station 5 comprises a laser-cutting head 7 on the upper frame leg 3 and a laser beam receiver 8 on the lower frame leg 4. The forming station 6 has an upper tool holder 9 on the upper frame leg 3 and a lower tool holder 10 on the lower frame leg 4. An upper tool in the form of a forming punch 11 is inserted in the upper tool holder 9 while, in the lower tool holder 10, a lower tool in the form of a forming die 12 is inserted. The forming punch 11 and the forming die 12 are parts of a forming tool 13.

Using a conventional stroke drive the forming tool 13, the forming punch 11 can be raised and lowered along a stroke axis 14 relative to the forming die 12. The upper tool holder 9 and the lower tool holder 10 can be rotationally adjusted (double arrow in FIG. 1) about the stroke axis 14 together with the forming punch 11 and the forming die 12. All of the functions of the machine tool 1 are controlled by a programmable numerical controller.

Plate-shaped workpieces, a metal sheet 15 in the example shown, are being processed on the laser-cutting station 5 and on the forming station 6. For processing purposes, the metal sheet 15 is moved by a conventional co-ordinate guidance system 16 with a two-axis horizontal movement across a workpiece support 17 of the machine tool 1 and, thus, relative to the laser-cutting head 7 and the laser beam receiver 8 and also relative to the forming tool 13. In FIG. 1, the metal sheet 15 is shown partly broken away, so that the laser beam receiver 8 and the lower tool holder 10 with the forming die 12 of the forming tool 13 can be seen in the drawing.

Figure 2:
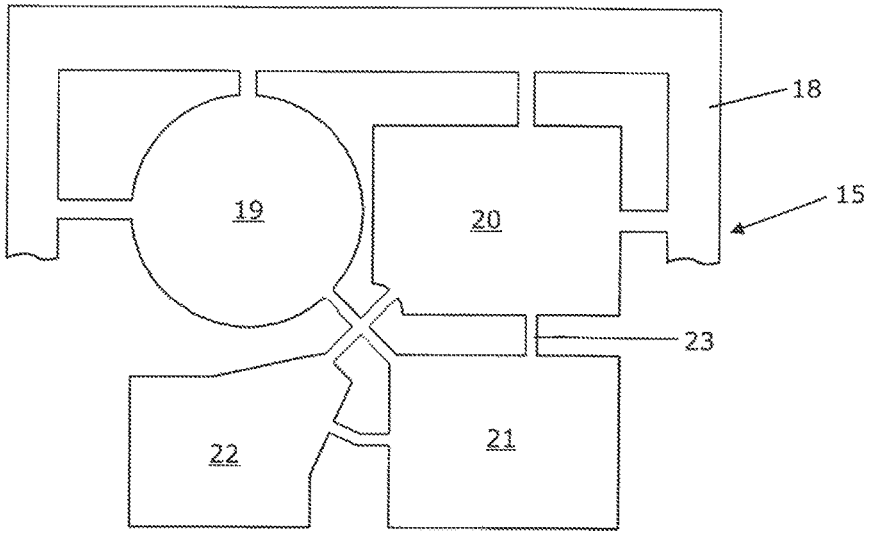
FIG. 2 shows sheet metal parts connected together by connecting webs and produced by the processing of a metal sheet on the machine tool according to FIG. 1.

As part of the processing operation performed on the machine tool 1, the metal sheet 15 initially undergoes a cutting operation on the laser-cutting station 5. A possible outcome of the cutting operation of the metal sheet 15 is shown in FIG. 2. Accordingly, by using the laser-cutting head 7 in a cutting operation, a skeleton 18, partially shown in FIG. 2, and sheet metal parts 19, 20, 21, 22 provided as finished parts are partially separated from one another as workpiece parts. As a result of a movement of the metal sheet 15 produced by the co-ordinate guidance system 16, a laser beam directed on to the metal sheet 15 by the laser-cutting head 7 cuts the sheet metal parts 19, 20, 21, 22, leaving the connecting webs 23 behind. Since the connecting webs 23 produce a residual connection, the skeleton 18 and the sheet metal parts 19, 20, 21, 22 are only partially separated from each other. Instead of the laser cutting beam, another type of cutting tool, in particular a punching tool inserted at the forming station 6 can be used for incompletely separating the skeleton 18 and the sheet metal parts 19, 20, 21, 22.

In the processing state according to FIG. 2, the metal sheet 15 is moved by the co-ordinate guidance system 16 to the forming station 6 of the machine tool 1. Here, the connecting webs 23 are pressure formed by the forming tool 13 inserted in the upper tool holder 9 and the lower tool holder 10.

Figure 3:
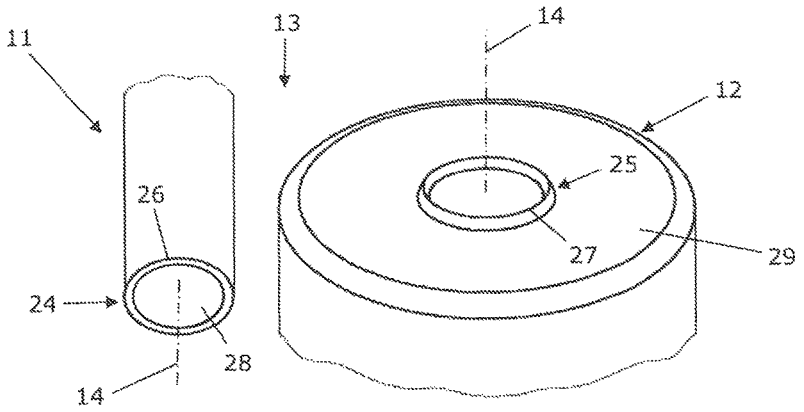
FIG. 3 shows a first embodiment of a forming tool for use at the forming station of the machine tool according to FIG. 1.

The forming tool 13 is shown in detail in FIG. 3 with the forming punch 11 provided as the upper tool and the forming die 12 provided as the lower tool. Here, the stroke axis 14 is indicated as a dotted line both on the forming punch 11 and on the forming die 12, along which stroke axis 14 the forming punch 11 is lowered in an operating stroke relative to the forming die 12 for pressure forming a connecting web 23.

With the forming tool 13 inserted in the upper tool holder 9 and the lower tool holder 10, a punch forming unit 24 and a die forming unit 25 oppose each other along the stroke axis 14. A planar annular front face 26 of the punch forming unit 24 and a circular linear face 27 of the die forming unit 25 point towards each other along the stroke axis 14.

To form the planar front face 26, the free end of the forming punch 11 is provided with an internal cone 28. The lateral surface of the internal cone 28, together with the stroke-aligned cylindrical outer surface of the forming punch 11 and the planar front face 26 extending perpendicular to the stroke axis 14, delimits a trapezoidal cross section of the punch forming unit 24. The upper limit of the trapezoidal cross section of the punch forming unit 24 is indicated by an imaginary dotted line in FIG. 5.

The die forming unit 25 protrudes beyond a support surface 29 of the forming die 12 towards the forming punch 11. The support surface 29 extends on the forming die 12 perpendicular to the stroke axis 14. The cross section of the die forming unit 25 is in the shape of an isosceles triangle with its base in the support surface 29 of the forming die 12 and its apex forming the linear front face 27 of the die forming unit 25.

Both the punch forming unit 24 and the die forming unit 25 extend endlessly about a circular line and, as such, are concentric with the stroke axis 14. In the transverse direction of the stroke axis 14, the punch forming unit 24 and the die forming unit 25 are offset from each other, wherein the planar front face 26 of the punch forming unit 24 is located inside the linear front face 27 of the die forming unit 25.

The sequence of operations for pressure forming the connecting webs 23 of the processed metal sheet 15 are described below using the example of one of the connecting webs 23 between the skeleton 18 and sheet metal part 20.

Before the start of the actual forming process, the processed metal sheet 15 is positioned using the co-ordinate guidance system 16 of the machine tool 1 relative to the forming tool 13, inserted on the forming station 6, such that the forming tool 13 assumes a process-ready position relative to the connecting web 23 to be formed. With the forming tool 13 in the process-ready position, the forming punch 11 of the forming tool 13 is spaced apart from the top side of the connecting web 23 and the workpiece parts adjacent to it along the stroke axis 14. Along the stroke axis 14, there is a minimal distance between the front face 27 of the die forming unit 25 and the underside of the connecting web 23 and the workpiece parts connected to it.

Figure 4:
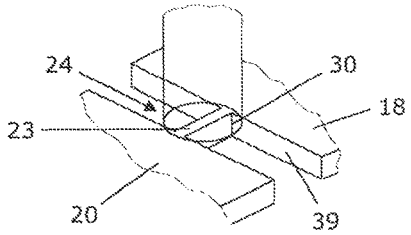
FIGS. 4 to 9 show schematic representations for illustrating the mode of operation of the forming tool according to FIG. 3 when forming connecting webs provided between two sheet metal parts.

Due to appropriate dimensioning of the diameter of the forming punch 11, the vertical projection of the planar front face 26 of the punch forming unit 24 of the forming punch 11 arranged in the process-ready position onto the top side of the processed metal sheet 15 extends at both ends of the connecting web 23 beyond a base 30 of the connecting web 23 at the respective workpiece part. This is illustrated in FIG. 4, wherein, in FIG. 4, only the vertical projection of the radially outermost limiting line of the planar front face 26 of the punch forming unit 24 is shown. On the underside of the skeleton 18 and of the sheet metal part 20, the vertical projection of the linear front face 27 of the die forming unit 25 onto the processed metal sheet 15 extends concentrically with and radially outside the vertical projection of the front face 26 of the punch forming unit 24.

Starting from the process-ready position, the forming punch 11 is moved with a processing stroke along the stroke axis 14 towards the forming die 12 into a stroke end position. In the cases exemplified in FIGS. 3 to 12, the processing stroke is controlled path-dependent, while, in the example shown in FIG. 13, the control of the processing stroke is force-dependent.

Where the control of the processing stroke of the forming punch 11 is path-dependent, the length of the processing stroke performed by the forming punch 11 relative to the forming die 12 can be variably adjusted and depends in particular on the desired residual thickness of the connecting web 23 after the forming operation. The distance traveled by the forming punch 11 along the stroke axis 14 is detected by means of a conventional distance measurement system and forms the basis for the control of the stroke drive of the machine tool 1.

The residual thickness of the connecting web 23 is also determined by the height of the die forming unit 25 measured along the stroke axis 14.

Figure 5:
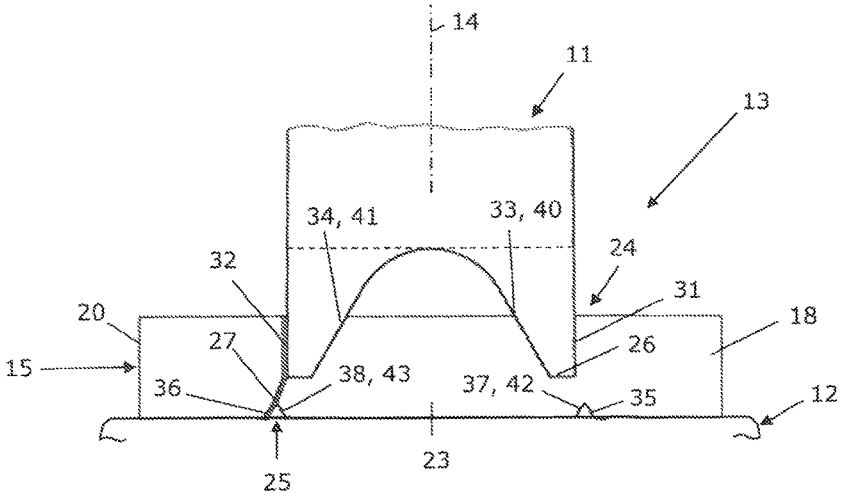

The conditions at the stroke end position of the forming punch 11 are illustrated in FIG. 5. Along the stroke axis 14, there is a distance between the front faces 26, 27 of the punch forming unit 24 and of the die forming unit 25 that is smaller than the thickness of the undeformed connecting web 23. The connecting web 23, the skeleton 18 and sheet metal part 20 are pressed due to the action of the forming punch 11 with their underside against the support surface 29 of the forming die 12.

During the processing stroke, the forming punch 11 with diametrically opposing unit sections of the punch forming unit 24 has plunged into the connecting web 23 at both ends thereof and into the adjacent areas of the skeleton 18 and of sheet metal part 20. A workpiece side 31 of the punch forming unit 24 faces the skeleton 18, a workpiece side 32 of the punch forming unit 24 faces the sheet metal part 20. Web sides 33, 34 of the punch forming unit 24 face towards the connecting web 23 and, therefore, face away from the residual web 18 and sheet part 20.

The conditions at the die forming unit 25 are corresponding. Due to the application of pressure onto the processed metal sheet 15 by the forming punch 11, the die forming unit 25 has been pressed, with two diametrically opposing unit sections, into the connecting web 23 at the ends thereof and into web-adjacent areas of the skeleton 18 and of the sheet metal part 20. Workpiece sides 35, 36 of the die forming units 25 face the skeleton 18 and the sheet metal part 20, web sides 37, 38 of the die forming unit 25 face away from the skeleton 18 and from the sheet metal part 20.

While the workpiece sides 31, 32 of the punch forming unit 24 extend parallel to the stroke axis 14 and also parallel to a cut face 39 created on the skeleton 18 as a result of the previous cutting operation on the sheet metal 15 and to a corresponding cut face on the sheet metal part 20, hidden in FIG. 4, the workpiece sides 35, 36 of the die forming unit 25 are inclined at an angle to the cut faces 39 on the skeleton 18 and the sheet metal part 20.

The punch forming unit 24 has forming faces 40, 41 on the web sides 33, 34. Forming faces 42, 43 are provided on the web sides 37, 38 of the die forming unit 25. The forming faces 40, 41 of the punch forming unit 24 extend starting from the front face 26 of the punch forming unit 24 along the stroke axis 14 away from the workpiece sides 31, 32 of the punch forming unit 24. Correspondingly, the forming faces 42, 43 of the die forming unit 25 extend away from the workpiece sides 35, 36 of the die forming unit 25 along the stroke axis 24.

Due to the resulting geometry of the punch forming unit 24 and of the die forming unit 25, on the web sides 33, 34, 37, 38 of the punch forming unit 24 and of the die forming unit 25 plasticized material of the connecting web 23 is displaced, due to the action of the forming tool 13 upon the connecting web 23, towards the connecting web 23 and, thus, away from the workpiece sides 31, 32, 35, 36 of the punch forming unit 24 and of the die forming unit 25.

On the ends of the connecting web 23, the cross section of the connecting web 23 along the stroke axis 14 is reduced by the pressure forming carried out by means of the forming tool 13. Due to the diameters of the front faces 26, 27 of the punch forming unit 24 and of the die forming unit 25 exceeding the dimension of the connecting web 23, the bases of reduced cross-section of the connecting web 23 at the skeleton 18 and at the sheet metal part 20 are set back relative to the cut faces 39 into the interior of the skeleton 18 and of the sheet metal part 20.

Figure 6:
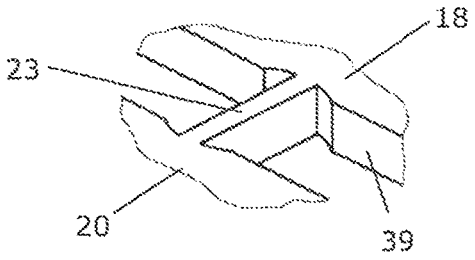

A corresponding offset of the bases of the cross-section-reduced connecting web 23 occurs at the skeleton 18 and at the sheet metal part 20 if the cut faces 39 on the skeleton 18 and on the sheet metal part 20 are provided with a corresponding setback already during the cutting processing of the sheet metal 15 preceding the press forming of the connecting web 23 (FIG. 6). In this case, during the pressure forming following the cutting processing of the sheet metal 15, only the connecting web 23 and not an area of the skeleton 18 and of the sheet metal part 20 immediately adjoining the connecting web 23 has to be processed. As a result, in the case of the processing situation according to FIG. 6, a smaller force needs to be applied for pressure forming the connecting web 23 than under the conditions according to FIG. 4.

Figure 7:
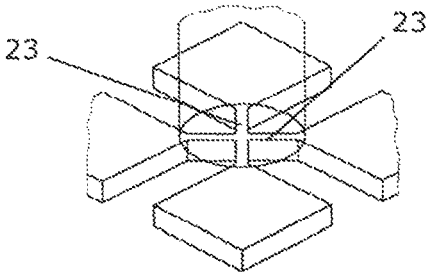
Figure 8:
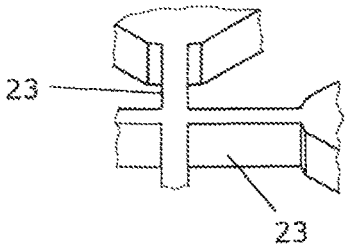

In the manner described referring to the connecting web 23 between the skeleton 18 and the sheet metal part 20 all the connecting webs 23 on the metal sheet 15 processed according to FIG. 2 are successively pressure formed. FIGS. 7 and 8 illustrate by way of example the processing of cruciform processing webs 23, as provided according to FIG. 2 between the sheet metal parts 19, 20, 21, 22. FIG. 7 deals with the case wherein not only the connecting webs 23 itself, but also immediately adjacent workpiece areas are to be formed, while, according to FIG. 8, workpiece areas immediately adjacent to the connecting webs 23 have been removed already during the previous cutting processing of the metal sheet 15 and, as a result, only the connecting webs 23 have to be formed.

Figure 9:
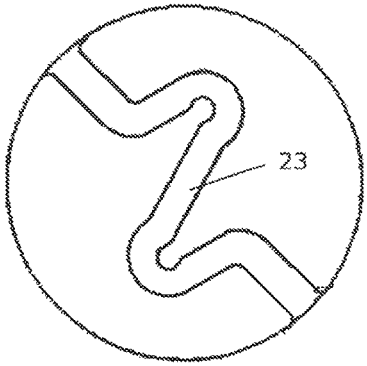

FIG. 9 shows a connecting web 23 provided between two workpiece parts incompletely separated from each other, which, like the rest of the workpiece processed by cutting, consists of a resilient material and that has been produced in a meandering shape during the incomplete separation of the adjoining workpiece parts.

Due to its material and because of its particular shape, the connecting web 23 is resilient and, thus, forms a flexure hinge between the two adjacent workpiece parts. If pressure is applied onto the connecting web 23 according to FIG. 9 in the manner illustrated in FIG. 5 by the forming punch 11 and the forming die 12 of the forming tool 13, the connecting web 23 offers only a relatively low resistance to the pressure forming due to its resilience. The resilience of the connecting web 23 facilitates the displacement of plasticized material of the connecting web 23 away from the workpiece sides 31, 32, 35, 36 of the punch forming unit 24 and of the die forming unit 25.

Figure 10A:
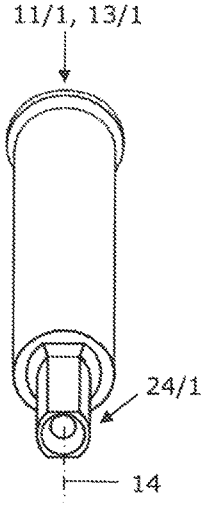
FIGS. 10A, 10B, and 10C show the upper tools of other embodiments of a forming tool for use on the forming station of the machine tool according to FIG. 1.
Figure 10B:
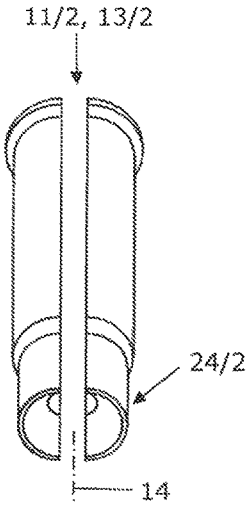
Figure 10C:
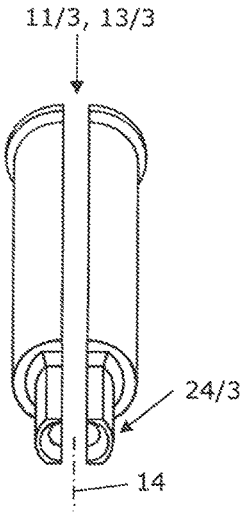

FIGS. 10A, 10B, and 10C show forming tools 13/1, 13/2, 13/3 differing in design from the forming tool 13, each to the extent of a forming punch 11/1, 11/2, 11/3. Unlike the punch forming unit 24 of the forming punch 11, a punch forming unit 24/1 of the forming punch 11/1 has an elliptical shape. The forming punch 11/2 is divided in a plane parallel to the stroke axis 14 and, consequently, has a two-part punch forming unit 24/2 wherein each segment of the punch forming unit 24/2 is semicircular in shape. The forming punch 11/3 is the result of dividing the forming punch 11/1 along a plane extending parallel to the stroke axis 14. Consequently, a punch forming unit 24/3 of the forming punch 11/3 is also segmented and comprises two structurally identical halves. Forming dies, not shown, are assigned to the forming punches 11/1, 11/2, 11/3 the forming dies having die forming units whose geometry is matched to the geometry of the punch forming units 24/1, 24/2, 24/3 and that, apart from that, correspond to the die forming unit 25 of the forming die 12 of the forming tool 13.

Figure 11:
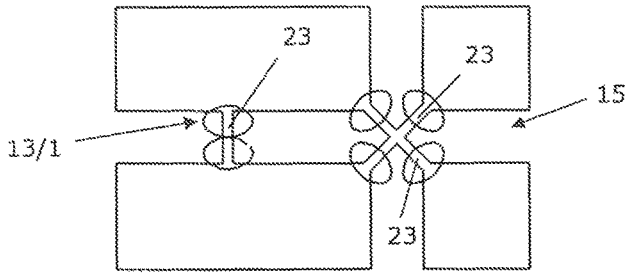
FIG. 11 shows a representation to illustrate the mode of operation of the forming tool according to FIG. 10A.
Figure 12:
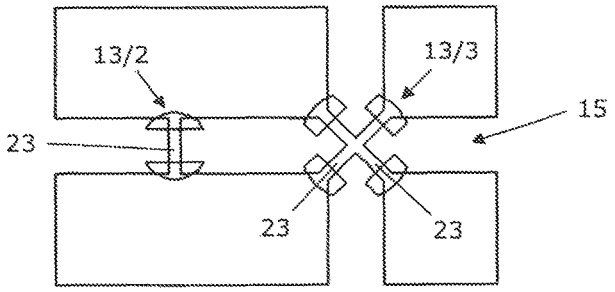
FIG. 12 shows a representation to illustrate the mode of operation of the forming tool according to FIG. 10B and of the forming tool according to FIG. 10C.

In FIGS. 11 and 12, processing strategies are illustrated, according to which connecting webs 23 between workpiece parts incompletely separated from each other can be pressure formed by means of the forming tools 13/1, 13/2, 13/3.

According to FIG. 11, pressure forming is carried out with multiple consecutive processing strokes of the forming tool 13/1 on the ends of connecting webs 23. In order to orient the forming tool 13/1 appropriately relative to the connecting web 23 to be processed, the forming punch 11/1 and the forming die assigned thereto are adjusted rotationally by turning the upper tool holder 9 and the lower tool holder 10 of the machine tool 1 about the stroke axis 14. In addition, the processed metal sheet 15 is positioned relative to the forming tool 13/1 by means of the co-ordinate guidance system 16 of the machine tool 1.

According to FIG. 12, a single connecting web 23 is processed by means of the forming tool 13/2. For pressure forming two cruciform connecting webs 23, the forming tool 13/3 is used. The forming tools 13/2, 13/3 carry out pressure forming on both ends of a connecting web 23 with a single processing stroke, wherein two consecutive processing strokes of the forming tool 13/3 are needed to process the two connecting webs 23 that cross each other in a X shape and wherein the forming tool 13/3 is rotated about the stroke axis 14 after the first processing stroke.

Figure 13:
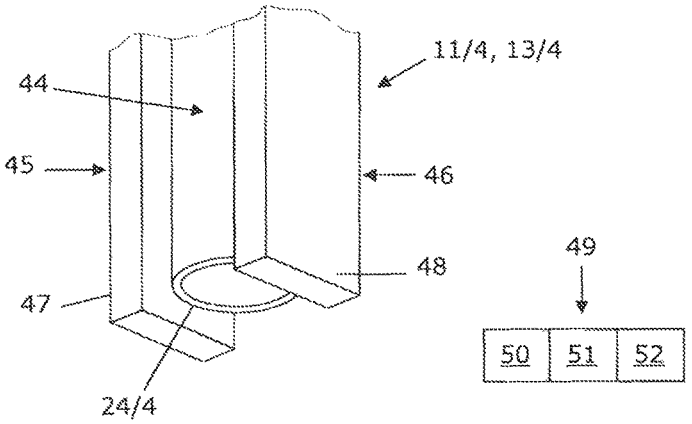
FIG. 13 shows a variant of the forming tool according to FIG. 3 for use if a processing stroke performed by the forming tool is controlled in a force-dependent manner.

According to FIG. 13, a tool part of a forming tool 13/4 is a forming punch 11/4. A forming die 12 according to FIG. 3, not shown in FIG. 13, is assigned to the forming punch 11/4 as a second tool part. A forming device 44 of the forming punch 11/4 corresponds to the forming punch 11 according to FIG. 3. The forming punch 11/4 terminates in a punch forming unit 24/4 with a trapezoidal cross section.

In addition to the forming device 44, the forming punch 11/4 has cheeks 45, 46, that project, relative to the punch forming unit 24/4 of the forming punch 11/4, along the stroke axis 14 towards the forming die 12, not shown, and thereby form projections 47, 48 of the forming punch 11/4.

For pressure forming a connecting web 23, the previously cut sheet 15 and the forming tool 13/4 are positioned relative to each other such that, when a processing stroke is performed by the forming punch 11/4 towards the forming die 12, the connecting web 23 to be formed is located between the projections 47, 48 of the forming punch 11/4. At the end of the processing stroke, the projections 47, 48 of the forming punch 11/4 touch down, with their front faces leading along the stroke axis 14, on the support surface 29 of the forming die 12. The amount by which the projections 47, 48 protrude relative to the punch forming unit 24/4 is dimensioned such that, in the stroke end position of the forming punch 11/4, there is a gap between the front face of the punch forming unit 24/4 and the front face of the die forming unit 25 along the stroke axis 14, wherein said gap corresponds to the desired residual thickness of the pressure formed connecting web 23. In the stroke end position, the forming punch 11/4 extends over the formed connecting web 23 like a portal. The projections 47, 48 of the forming punch 11/4 are laterally adjacent to the connecting web 23 like portal columns.

The control of the processing stroke performed by the forming punch 11/4 relative to the forming die 12 is force-dependent. For this purpose, a stroke control device 49, illustrated in outline form in FIG. 13, for the stroke drive of the forming tool 13/4 is incorporated in the programmable numerical controller of the machine tool 1.

The stroke control device 49 comprises a force measuring device 50, an evaluation device 51 and an actuating device 52. By means the force measuring device 50, the amount of the supporting force is measured, with which the forming punch 11/4 of the forming tool 13/4 is supported on the forming die 12 along the stroke axis 14. In the evaluation device 51, the actual measured value of the supporting force is compared with a limit value of the supporting force stored in the stroke control device 49. If the actual measured value of the supporting force reaches the given limit value, this indicates that the forming punch 11/4 has reached its stroke end position along the stroke axis 14. Consequently, the evaluation device 51 generates a switch signal for the actuating device 52. At a result of the switch signal generated by the evaluation device 51, the actuating device 52 actuates the stroke drive of the forming tool 13/4 such that the processing stroke of the forming punch 11/4 directed towards the forming die 12 terminates and retraction of the forming punch 11/4 is initiated in the counter direction of the processing stroke.

Figure 14:
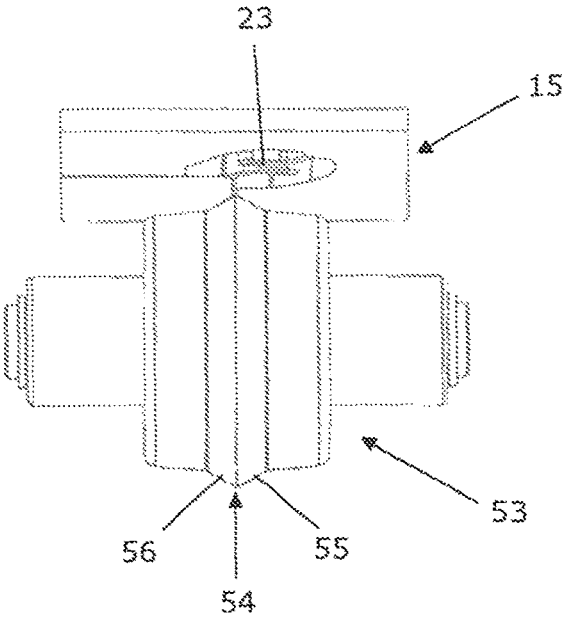
FIG. 14 shows two sheet metal parts connected together by a connecting web during edge processing of the sheet metal parts.

FIG. 14 illustrates a method step that is performed in the illustrated example in the processing of the metal sheet 15 before the connecting webs 23 are pressure formed. Here, incompletely separated sheet parts with resilient connecting webs 23 left are edge-processed on the underside thereof.

To this end, a forming roller 53 is provided that is inserted in the lower tool holder 10 on the forming station 6 of the machine tool 1. In the processing of the sheet parts of a metal sheet previously cut, the forming roller 53 interacts with a counter pressure roller, not shown in FIG. 14, that is inserted in the upper tool holder 9 of the machine tool 1 and that rests on the upper side of the processed metal sheet with a cylindrical lateral surface. The forming roller 53 is provided with a double conical bead 54 that has two conical forming surfaces 55, 56.

To carry out the edge processing of the incompletely separated sheet metal parts of the cut metal sheet, the cut metal sheet is moved by means of the co-ordinate guidance system 16 over the workpiece support 17 of the machine tool 1 such that the forming roller 53 pressed against the sheet metal parts rolls along the edges of the sheet metal parts, thereby producing beveled faces (chamfers) on the edges of the sheet metal parts by means of the forming surfaces 55, 56. In doing so, the bases of the connecting webs 23 on sheet metal parts are avoided. A corresponding beveled face is produced in these areas, following the edge processing of the incompletely separated sheet metal parts, during the pressure forming of the connecting webs 23 by means of the die forming unit 25 of the forming tool 13, or, respectively, by means of the die forming units of the forming tools 13/1, 13/2, 13/3, 13/4.

After the pressure forming of all connecting webs 23 of a processed metal sheet, the sheet metal parts, in the example according to FIG. 2 the sheet metal parts 19, 20, 21, 22 of the processed metal sheet 15, are released from the associated skeleton (skeleton 18 in FIG. 2). Due to the reduction in the cross section of the connecting webs 23, the processed metal sheet just needs to be shaken to do this. Due to the load acting on them, the connecting webs 23 break in the fracture zones produced by pressure forming, wherein, due to the geometry of the punch forming units 24, 24/1, 24/2, 24/3, 24/4 and of the associated die forming units of the forming tools 13, 13/1, 13/2, 13/3, 13/4, no, or practically minimal traces of the connecting webs 23 remain on the sheet metal parts. If, due to the appropriate dimensioning of the punch forming units 24, 24/1, 24/2, 24/3, 24/4 and of the die forming units, the bases of the connecting webs 23 having reduced diameters are set back into the interior of the sheet metal parts, even residues of the connecting webs 23 left on the sheet metal parts do not protrude beyond the cut faces of the sheet metal parts produced before the pressure forming of the connecting webs 23.

A number of embodiments of the invention have been described. Nevertheless, it will be understood that various modifications may be made without departing from the spirit and scope of the invention. Accordingly, other embodiments are within the scope of the following claims.

What is claimed is:

1. A forming tool for pressure forming a connecting web attached by ends of the connecting web to workpiece parts to connect the workpiece parts together, the forming tool comprising:

a first tool part having a first forming unit and positioned on a first side of the connecting web; and a second tool part having a second forming unit and positioned on a second side of the connecting web opposite the first side, wherein the first tool part and the second tool part are configured to move relative to one another along a stroke axis that extends transversely to the first side and the second side of the connecting web, wherein the first forming unit has a first face and the second forming unit has a second face facing toward the first face, wherein each of the forming units has a workpiece side and a connecting web side, wherein the workpiece side of each of the forming units is configured to face the same workpiece part when pressure forming the connecting web, wherein the connecting web side of each of the forming units is configured to face away from the same workpiece part when pressure forming the connecting web, wherein the first tool part and the second tool part are configured to move relative to each other along the stroke axis with a processing stroke starting from a process-ready position of the first and second tool parts to a stroke end position of the first and second tool parts, the first and second tool parts thereby pressure forming the connecting web, wherein, in the process-ready position of the first and second tool parts, the first face of the first forming unit of the first tool part is adjacent to, but spaced apart from the undeformed connecting web on the first side thereof and the second face of the second forming unit of the second tool part is adjacent to the undeformed connecting web on the second side thereof, the undeformed connecting web having an uncompressed height along the stroke axis and wherein, in the stroke end position of the first and second tool parts, the first forming unit of the first forming tool has plunged into the connecting web such that the connecting web is deformed and has a compressed height along the stroke axis between the first face of the first forming unit of the first tool part and the second face of the second forming unit of the second tool part which compressed height of the deformed connecting web is smaller than the uncompressed height of the undeformed connecting web, wherein each of the forming units has a forming surface on the connecting web side that extends along the stroke axis from the face of the respective forming unit away from the workpiece side of the respective forming unit, and wherein the face of the first forming unit and the face of the second forming unit are offset relative to each other transversely to the stroke axis.

2. The forming tool according to claim 1, wherein one of the first tool part and the second tool part has a support surface extending substantially perpendicular to the stroke axis, from which support surface the forming unit of the tool part having the support surface projects towards the other of the first tool part and the second tool part.

3. The forming tool according to claim 1, wherein at least of one of the first forming unit and the second forming unit has a triangular cross section in a section plane extending parallel to the stroke axis.

4. The forming tool according to claim 1, wherein at least of one of the first forming unit and the second forming unit has a trapezoidal cross section in a section plane extending parallel to the stroke axis.

5. The forming tool according to claim 1, wherein in a section plane extending parallel to the stroke axis, at least one of the first forming unit and the second forming unit has a triangular cross section and the other one of the forming units has a trapezoidal cross section.

6. The forming tool according to claim 1, wherein on at least one of the first tool part and the second tool part, the first forming unit and/or the second forming unit is formed by a free end of the respective tool part having a cavity.

7. The forming tool according to claim 6, wherein the cavity is an internal cone.

8. The forming tool according to claim 1, wherein at least one of the first forming unit and the second forming unit on the workpiece side extends along the stroke axis parallel to a cut face of a workpiece part that the workpiece side of the respective forming unit is facing during the pressure forming of the connecting web.

9. The forming tool according to claim 1, wherein at least one of the first forming unit and the second forming unit on the workpiece side extends along the stroke axis at an angle relative to a cut face of a workpiece part that the workpiece side of the respective forming unit is facing during the pressure forming of the connecting web.

10. The forming tool according to claim 1, wherein one of the first forming unit and the second forming unit on the workpiece side extends along the stroke axis parallel to a cut face of a workpiece part and the other of the first forming unit and the second forming unit on the workpiece side extends along the stroke axis at an angle relative to the cut face on the workpiece part that the workpiece sides of the first forming unit and the second forming unit faces during the pressure forming of the connecting web.

11. A forming tool for pressure forming a connecting web attached by ends of the connecting web to workpiece parts to connect the workpiece parts together, the forming tool comprising:

a first tool part having a first forming unit and positioned on a first side of the connecting web; and a second tool part having a second forming unit and positioned on a second side of the connecting web opposite the first side, wherein the first tool part and the second tool part are configured to move relative to one another along a stroke axis that extends transversely to the first side and the second side of the connecting web, wherein the first forming unit has a first face and the second forming unit has a second face facing toward the first face, wherein each of the forming units has a workpiece side and a connecting web side, wherein the workpiece side of each of the forming units is configured to face the same workpiece part when pressure forming the connecting web, wherein the connecting web side of each of the forming units is configured to face away from the same workpiece part when pressure forming the connecting web, wherein the first tool part and the second tool part are configured to move relative to each other along the stroke axis with a processing stroke starting from a process-ready position of the first and second tool parts to a stroke end position of the first and second tool parts, the first and second tool parts thereby pressure forming the connecting web, wherein, in the process-ready position of the first and second tool parts, the first face of the first forming unit of the first tool part is adjacent to, but spaced apart from the undeformed connecting web on the first side thereof and the second face of the second forming unit of the second tool part is adjacent to the undeformed connecting web on the second side thereof, the undeformed connecting web having an uncompressed height along the stroke axis and wherein, in the stroke end position of the first and second tool parts, the first forming unit of the first forming tool has plunged into the connecting web such that the connecting web is deformed and has a compressed height along the stroke axis between the first face of the first forming unit of the first tool part and the second face of the second forming unit of the second tool part which compressed height of the deformed connecting web is smaller than the uncompressed height of the undeformed web, wherein each of the forming units has a forming surface on the connecting web side that extends along the stroke axis from the face of the respective forming unit away from the workpiece side of the respective forming unit, wherein each of the forming units has unit sections that are offset relative to each other, wherein the unit sections of each of the forming units are configured to pressure form the connecting web at multiple places that are displaced from each other along the connecting web, wherein a unit section of one of the forming units and a unit section of the other of the forming units comprise a unit section pair, wherein the forming units on the unit sections of the unit section pairs each have a workpiece side and a connecting web side and, when the connecting web is being pressure formed, the workpiece sides of the unit sections of a unit section pair are facing one and the same workpiece part and the connecting web sides of the unit sections of a unit section pair are facing away from this workpiece part, and wherein the workpiece sides of the unit sections of different unit section pairs are facing different workpiece parts and the connecting web sides of the unit sections of different unit section pairs are facing away from different workpiece parts.

12. The forming tool according to claim 11, wherein the first forming unit and the second forming unit each extend in a circumferential direction about the stroke axis.

13. The forming tool according to claim 12, wherein the first forming unit and the second forming unit each extend in a circumferential direction curved along respective circular arcs around the stroke axis.

14. The forming tool according to claim 12, wherein at least of one of the first forming unit and the second forming unit extends endlessly in the circumferential direction about the stroke axis.

15. A forming tool for pressure forming a connecting web attached by ends of the connecting web to workpiece parts to connect the workpiece parts together, the forming tool comprising:

a first tool part having a first forming unit and positioned on a first side of the connecting web; and a second tool part having a second forming unit and positioned on a second side of the connecting web opposite the first side, wherein the first tool part and the second tool part are configured to move relative to one another along a stroke axis that extends transversely to the first side and the second side of the connecting web, wherein the first forming unit has a first face and the second forming unit has a second face facing toward the first face, wherein each of the forming units has a workpiece side and a connecting web side, wherein the workpiece side of each of the forming units is configured to face the same workpiece part when pressure forming the connecting web, wherein the connecting web side of each of the forming units is configured to face away from the same workpiece part when pressure forming the connecting web, wherein the first tool part and the second tool part are configured to move relative to each other along the stroke axis with a processing stroke starting from a process-ready position of the first and second tool parts to a stroke end position of the first and second tool parts, the first and second tool parts thereby pressure forming the connecting web, wherein, in the process-ready position of the first and second tool parts, the first face of the first forming unit of the first tool part is adjacent to, but spaced apart from the undeformed connecting web on the first side thereof and the second face of the second forming unit of the second tool part is adjacent to the undeformed connecting web on the second side thereof, the undeformed connecting web having an uncompressed height along the stroke axis and wherein, in the stroke end position of the first and second tool parts, the first forming unit of the first forming tool has plunged into the connecting web such that the connecting web is deformed and has a compressed height along the stroke axis between the first face of the first forming unit of the first tool part and the second face of the second forming unit of the second tool part which compressed height of the deformed connecting web is smaller than the uncompressed height of the undeformed web, wherein each of the forming units has a forming surface on the connecting web side that extends along the stroke axis from the face of the respective forming unit away from the workpiece side of the respective forming unit, wherein at least one of the first tool part and the second tool part has a projection that extends along the stroke axis towards the other one of the first tool part and the second tool part, and wherein the first tool part and the second tool part are configured to be supported on each other by the projection along the stroke axis and bypassing the connecting web when moved to the stroke end position.

16. The forming tool according to claim 15, further comprising a stroke drive configured to drive the first tool part and the second tool part relative to each other, wherein the stroke drive comprises a stroke control device that comprises a force measuring device, an evaluation device connected to the a force measuring device, and an actuating device connected to the evaluation device of the stroke control device and the stroke drive, wherein, the force measuring device of the stroke control device is configured to measure the amount of a supporting force by which the first tool part and the second tool part are supported on each other by the projection extending along the stroke axis during the processing stroke, wherein the evaluation device is configured to compare the amount of the supporting force with a limit value of the supporting force assigned to the stroke end position, wherein the evaluation device is configured to generate a switch signal when the limit value of the supporting force is reached or exceeded, and wherein the actuating device is configured to actuate the stroke drive of the forming tool to terminate the processing stroke in response to generation of the switch signal.

17. A method for pressure forming a connecting web, attached by ends of the connecting web to workpiece parts to connect together the workpiece parts that occur as processing products from an operation cutting a workpiece that is configured as a plate, the method comprising:

moving two tool parts positioned on opposite sides of the connecting web relative to one another along a stroke axis extending transversely to the connecting web;

acting upon the connecting web by forming units of the two tool parts provided on the opposite sides of the connecting web and facing each other along the stroke axis at free ends with faces along the stroke axis wherein each of the forming units has a workpiece side and a connecting web side, wherein the two tool parts are aligned relative to the connecting web such that the workpiece side of the forming units is facing one and the same workpiece part and the connecting web side of the forming units is turned away from the workpiece part;

moving the two tool parts towards each other along the stroke axis with a processing stroke starting from a process-ready position of the two tool parts to a stroke end position of the two tool parts, wherein, in the process-ready position of the two tool parts, a first face of a first forming unit of a first tool part of the two tool parts is adjacent to, but spaced apart from the undeformed connecting web on the first side thereof and a second face of a second forming unit of a second tool part of the two tool parts is adjacent to the undeformed connecting web on the second side thereof, the undeformed connecting web having an uncompressed height along the stroke axis and wherein, in the stroke end position of the two tool parts, the first forming unit of the first forming tool has plunged into the connecting web such that the connecting web is deformed and has a compressed height along the stroke axis between the first face of the first forming unit of the first tool part and the second face of the second forming unit of the second tool part which compressed height of the deformed connecting web is smaller than the uncompressed height of the undeformed connecting web;

plasticizing material of the connecting web on opposite sides of the connecting web by using the forming units; and displacing the plasticized material of the connecting web on the connecting web side of the forming units away from the workpiece side of the forming units by the forming faces of the forming units.

18. A method for processing workpieces that are configured as plates, the method comprising:

partially separating two workpiece parts from each other with a cut face produced on each of the two workpiece parts and with at least one connecting web left attached by ends of the at least one connecting web to the two workpiece parts, thus connecting the two workpiece parts together and such that the at least one connecting web extends transversely to the cut faces;

pressure forming the at least one connecting web after partially separating the two workpiece parts; and then, completely separating the two workpiece parts from each other by removing the connection produced by pressure forming the at least one connecting web.

19. The method according to claim 18 wherein pressure forming comprises plasticizing material of the connecting web on opposite sides of the connecting web.

20. The method in accordance with claim 19, wherein the method comprises:

partially separating two workpiece parts from each other by cutting a workpiece that is configured as a plate, in particular a metal sheet, of an elastically deformable material; and producing the at least one connecting web as a flexure hinge the at least one connecting web thus being resilient in the transverse direction of the cut faces of the workpiece parts connected together by the at least one connecting web.

21. The method in accordance with claim 18, further comprising edge processing at least one of the partially separated workpiece parts before completely separating the workpiece parts.

22. A machine tool, the machine tool comprising:

a machine frame comprising a workpiece support structure for supporting workpiece parts; and a forming tool connected to the machine frame, the forming tool configured for pressure forming a connecting web attached by ends of the connecting web to workpiece parts to connect the workpiece parts together, the forming tool comprising:

a first tool part having a first forming unit and positioned on a first side of the connecting web; and a second tool part having a second forming unit and positioned on a second side of the connecting web opposite the first side, wherein the first tool part and the second tool part are configured to move relative to one another along a stroke axis that extends transversely to the first side and the second side of the connecting web, wherein the first forming unit has a first face and the second forming unit has a second face facing toward the first face, wherein each of the forming units has a workpiece side and a connecting web side, wherein the workpiece side of each of the forming units is configured to face the same workpiece part when pressure forming the connecting web, wherein the connecting web side of each of the forming units is configured to face away from the same workpiece part when pressure forming the connecting web, wherein the first tool part and the second tool part are configured to move relative to each other along the stroke axis with a processing stroke starting from a process-ready position of the first and second tool parts to a stroke end position of the first and second tool parts, the first and second tool parts thereby pressure forming the connecting web, wherein, in the process-ready position of the first and second tool parts, the first face of the first forming unit of the first tool part is adjacent to, but spaced apart from the undeformed connecting web on the first side thereof and the second face of the second forming unit of the second tool part is adjacent to the undeformed connecting web on the second side thereof, the undeformed connecting web having an uncompressed height along the stroke axis and wherein, in the stroke end position of the first and second tool parts, the first forming unit of the first forming tool has plunged into the connecting web such that the connecting web is deformed and has a compressed height along the stroke axis between the first face of the first forming unit of the first tool part and the second face of the second forming unit of the second tool part which compressed height of the deformed connecting web is smaller than the uncompressed height of the undeformed web, wherein each of the forming units has a forming surface on the connecting web side that extends along the stroke axis from the face of the respective forming unit away from the workpiece side of the respective forming unit, and wherein the face of the first forming unit and the face of the second forming unit are offset relative to each other transversely to the stroke axis, or wherein each of the forming units has unit sections that are offset relative to each other, wherein the unit sections of each of the forming units are configured to pressure form the connecting web at multiple places that are displaced from each other along the connecting web, wherein a unit section of one of the forming units and a unit section of the other of the forming units comprise a unit section pair, wherein the forming units on the unit sections of the unit section pairs each have a workpiece side and a connecting web side and, when the connecting web is being pressure formed, the workpiece sides of the unit sections of a unit section pair are facing one and the same workpiece part and the connecting web sides of the unit sections of a unit section pair are facing away from this workpiece part, and wherein the workpiece sides of the unit sections of different unit section pairs are facing different workpiece parts and the connecting web sides of the unit sections of different unit section pairs are facing away from different workpiece parts, or wherein at least one of the first tool part and the second tool part has a projection that extends along the stroke axis towards the other one of the first tool part and the second tool part and wherein the first tool part and the second tool part are configured to be supported on each other by the projection along the stroke axis and bypassing the connecting web when moved to the stroke end position.

* * * * *